United States Patent [19]

Zaitsu et al.

[11] Patent Number: 5,030,991

[45] Date of Patent: Jul. 9, 1991

[54] JAM DETECTION AND CLEARANCE SYSTEM FOR DUPLEX COPIERS

[75] Inventors: Hirohachi Zaitsu, Yokohama; Yukihiro Fukushi, Kawasaki, both of Japan

[73] Assignee: Kabushiki Kaisha Toshiba, Kasawaki, Japan

[21] Appl. No.: 202,011

[22] Filed: Jun. 2, 1988

[30] Foreign Application Priority Data

Jun. 5, 1987 [JP] Japan ..... 62-139950

[51] Int. Cl.[5] ..... G03G 21/00

[52] U.S. Cl. ..... 355/207; 271/259; 355/308; 355/319

[58] Field of Search ..... 355/207, 308, 319, 318, 355/24, 315, 316, 317, 206, 205, 321, 320, 207, 308, 319; 271/259, 256, 258

[56] References Cited

U.S. PATENT DOCUMENTS

| | | | |
|---|---|---|---|
| 4,166,615 | 9/1979 | Noguchi et al. | 271/259 |
| 4,231,567 | 11/1980 | Ziehm | 271/259 |
| 4,472,049 | 9/1984 | Honma | 355/317 X |
| 4,478,506 | 10/1984 | Miyoshi | 355/315 X |
| 4,497,569 | 2/1985 | Booth, Sr. | 355/14 |
| 4,526,464 | 7/1985 | Milillo | 355/321 X |
| 4,573,789 | 3/1986 | Wada | 355/14 |
| 4,743,945 | 5/1988 | Ito | 355/317 X |
| 4,750,020 | 6/1988 | Ishizu | 355/205 |

FOREIGN PATENT DOCUMENTS

| | | | |
|---|---|---|---|
| 055665 | 3/1987 | Japan | 355/321 |

*Primary Examiner*—A. T. Grimley
*Assistant Examiner*—Thu Dang
*Attorney, Agent, or Firm*—Foley & Lardner

[57] ABSTRACT

An electronic copying machine according to the present invention has a copying unit for forming images on paper sheets and then discharging them, and a resupply unit for resupplying the same paper sheets to the copying unit, for other images to be formed on the sheets. The resupply unit has a pull-out unit which can readily removed therefrom, and the copying unit has a jam sensor for detecting that a paper sheet is jammed between the copying unit and the pull-out unit. When the jam sensor detects the jamming of a paper sheet when the copying machine is in overlap copying mode, the jammed paper sheet is forcedly discharged from the resupply unit. Alternatively, when the jam sensor detects the jamming of a paper sheet when the copying machine is in double-sided copying mode, the jammed paper sheet is forcedly pulled into the resupply unit.

9 Claims, 9 Drawing Sheets

JAM DETECTION AND CLEARANCE SYSTEM FOR DUPLEX COPIERS

BACKGROUND OF THE INVENTION

1. Field of the Invention

The present invention relates to an image forming apparatus having a function whereby a sheet of paper on which an image has been formed, at an image forming section, is again supplied thereto in order for images to be formed on both sides of the paper sheet, or for overlapping images to be formed on one side thereof.

2. Description of the Related Art

An electronic copying machine having the above-described function has been developed in recent times, and includes a copying unit for forming copied images on a paper sheet, and a supply unit for resupplying the same paper sheet to the copying unit, in order for another image to be formed thereon. The above electronic copying machine operates as follows:

First, with the copying machine being in the overlap copying mode, a single sheet of paper from a paper-storage cassette attached to the copying unit is picked up by means of paper supply rollers, is aligned by a pair of first aligning rollers, and then fed between a photosensitive drum and a transfer charger, the transfer charger causing a toner image to be transferred from the photosensitive drum to one side of the paper sheet. After the toner image has been fixed to the paper sheet by a pair of fixing rollers, the sheet is introduced, through a first gate, to a stacker of the re-supply unit. Paper sheets stacked in the stacker are picked up one by one by pickup rollers, are aligned by a pair of second aligning rollers, and then fed, through a second gate, to the first aligning rollers at the copying unit, and again between the photosensitive drum and transfer charger, where another toner image is transferred from the photosensitive drum onto that side of the paper sheet on which the preceding image was formed. Thereafter, the paper sheet is discharged onto a discharge tray, via the fixing rollers and a pair of discharge rollers.

With the copying machine in the double-sided copying mode, paper sheets stacked in the stacker are, as in the case of the overlap copying mode, picked up one by one by the pickup rollers, are aligned by the second aligning rollers, and then fed, through the second gate, to a pair of switchback rollers which change the sheet-conveying direction. A paper sheet whose conveying direction has been thus changed is then fed, through a third gate, to the first aligning rollers at the copying unit, where a toner image is transferred from the photosensitive drum onto that side of the paper sheet which is opposite to the side on which an image was formed in the preceding image-forming step. Thereafter, the paper sheet is discharged onto the discharge tray, via the fixing and discharge rollers.

The stacker, the pickup rollers, the aligning rollers, the second gate, the third gate, and the switchback rollers are assembled as a single pull-out unit which can be readily removed from the resupply unit.

Thus, when a sheet of paper becomes jammed between the aligning rollers at the copying unit and the aligning rollers at the resupply unit, or between the aligning rollers at the copying unit and the switchback rollers at the resupply unit, the pull-out unit is removed from the resupply unit, whereby the jammed paper sheet can be more easily removed.

However, when a paper sheet is jammed such that its back end is held between the second aligning rollers or switchback rollers, with its front end introduced into the copying unit, then the sheet will be torn in two upon removal of the pull-out unit, thereby making it more difficult to eliminate the jamming.

SUMMARY OF THE INVENTION

The object of the present invention is, therefore, to provide an image forming apparatus whereby sheet of paper jammed between a conveying means and a resupply means can be removed therefrom without being torn in two.

According to an aspect of the present invention, there is provided an image forming apparatus comprising image forming means for forming images on paper sheets, transporting means for transporting the paper sheets to the image forming means, and transporting the paper sheets on which images have been formed, from the image forming means to the outside of the apparatus, re-transporting means for transporting paper sheets on which images have been formed, back to the image forming means, so that the image forming means can form other images thereon, supporting means for supporting the re-transporting means, and which can move between a first position, adjacent to the transporting means, and a second position, remote therefrom, detecting means for detecting that a sheet of paper is jammed between the transporting means and the re-transporting means, and driving means for forcedly driving the re-transporting means when the detector means detects jamming of a paper sheet.

DETAILED DESCRIPTION OF THE PREFERRED EMBODIMENT

An embodiment of the present invention will now be described, with reference to the accompanying drawings.

Figure 1:
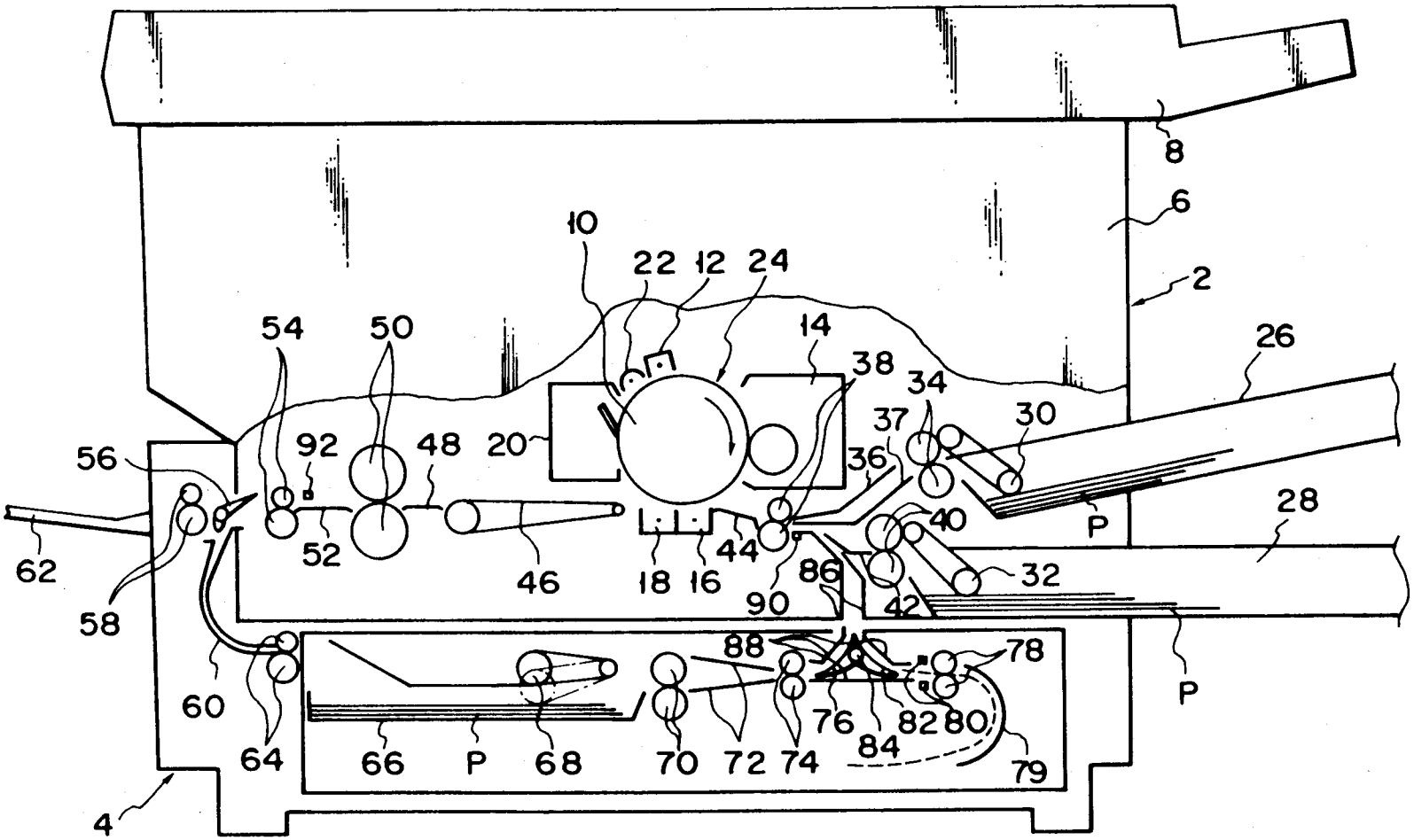
FIG. 1 shows an electronic copying machine which is an example of the image forming apparatus according to the present invention.

FIG. 1 shows an electronic copying machine which is an example of the image forming apparatus according to the present invention and which can copy images on both sides of a paper sheet, or overlapping images on one side thereof.

This electronic copying machine includes copying unit 2 and paper resupply unit 4. Copying unit 2 has housing 6 on which is arranged a table (not shown) on which originals are placed. Feeder 8 for automatically feeding the originals is arranged over housing 6 such that it covers the originals table. An operation panel is positioned on the surface of housing 6, at the front side thereof, and has a copy button for starting the copying operation, and selection keys for selecting any of normal, overlapping, and double-sided copying modes.

Photosensitive drum 10 is supported in housing 6 such that it is freely rotatable. Electrifying charger 12, developing device 14, transfer charger 16, peeling-off charger 18, cleaning device 20, and electricity removing charger 22 are arranged around the circumference of photosensitive drum 10 and along the rotating direction thereof. Exposing position 24 of an exposing device (not shown) is set between charger 12 for electrifying photosensitive drum 10 and developing device 14. This exposing means illuminates the original mounted on the originals table and introduces light reflected from the original to exposing position 24 on the surface of photosensitive drum 10, to expose the surface of photosensitive drum 10 in order that a static latent image can be formed on the surface thereof. Developing device 14 supplies toner to the static latent image and forms a toner image on photosensitive drum 10, From which the toner image is transferred, by transfer charger 16, onto a sheet of paper P. Paper sheet P, now statically stuck to drum 10, is peeled off therefrom by peeling-off charger 18. Any toner which was not transferred to the paper sheet P, and which remains on photosensitive drum 10, is removed therefrom by cleaning device 20, and any electricity on the surface of drum 10, after it has been cleaned, is removed therefrom by electricity removing charger 22.

Upper and lower paper sheet supply cassettes 26 and 28, for storing paper sheets P, are set at one side of housing 6, and paper sheet supply rollers 30 and 32 are arranged in housing 6 such that they correspond to cassettes 26 and 28. Paper sheet supply roller 30 serves to feed a sheet of paper stored in upper paper sheet supply cassette 26 toward a pair of conveying rollers 34. Conveying rollers 34 convey the paper sheet P to first aligning rollers 38, through guides 36 and 37. Paper sheet supply roller 32, on the other hand, serves to feed a sheet of paper stored in lower paper sheet supply cassette 28 toward a pair of conveying rollers 40. Conveying rollers 40 convey this paper sheet P also to first aligning rollers 38, through guides 37 and 42. First aligning rollers 38 align the paper sheet P and then convey it between photosensitive drum 10 and transfer charger 16, through guide 44. Transfer charger 16 transfers a toner image held on the surface of photosensitive drum 10 to paper sheet P, after which peeling-off charger 18, located adjacent to transfer charger 16, peels off the paper sheet P, which is now statically stuck to photosensitive drum 10 at the time of transferring the toner image, and introduces it onto conveyer belt 46. Conveyer belt 46 conveys the paper sheet P, through guide 48, to a pair of fixing rollers 50 Which then convey sheet P to a pair of first discharge rollers 54, through guide 52, while fixing the transferred toner image on the paper sheet P. Discharge rollers 54 discharge the paper sheet P outside housing 6 of copying unit 2 and introduce it into paper sheet resupply unit 4.

Paper sheet resupply unit 4 is located under copying unit 2. First gate 56 is located in paper sheet resupply unit 4, and corresponds to first discharge rollers 54. First gate 56 distributes the paper sheet P conveyed through first discharge rollers 54 to a pair of second discharge rollers 58 or a pair of turn guides 60. Second discharge rollers 58 discharge the paper sheet P onto discharge tray 62 located outside resupply unit 4, while turn guides 60 turn a paper sheet P supplied thereto and guide it to a pair of stack rollers 64 which stack the sheet in stacker 66. Pickup rollers 68 are located above stacker 66, and pick up the paper sheets P stacked in stacker 66 and convey them toward a pair of separating rollers 70, which separate a paper sheet from those stacked in stacker 66 and feed it to second aligning rollers 74, through a pair of guides 72. Second aligning rollers 74 align the paper sheet P and then feed it to second gate 76, which selectively guides the sheet to first aligning rollers 38 in copying unit 2 or a pair of switchback rollers 78. Switchback rollers 78 pull the front end of the paper sheet P therebetween, to feed it along guide 79, and when the back end of the sheet is detected by switchback sensors 80, switchback rollers 78 reverse direction to feed the sheet to third gate 82, locating the back end of the sheet forward. Third gate 82 is supported by the same shaft 84 which supports second gate 76, and guides the paper sheet P to first aligning rollers 38. A pair of guides 86 is located in copying unit 2 in order to guide the paper sheet P guided to aligning rollers 38 by second gate 76 or third gate 82, and a plurality of guides 88, also for the purpose of guiding the paper sheet P, are located adjacent to the second and third gates.

First jam sensor 90 is located adjacent to first aligning rollers 38 in copying unit 2, and when this sensor has not detected paper sheet P after the elapse of a certain time period from second aligning rollers 74 commencing their rotation, it then signals that the sheet is jammed between first and second aligning rollers 38 and 74.

Second jam sensor 92 is located adjacent to first discharge rollers 54 in copying unit 2, and when this sensor has not detected paper sheet P after the elapse of a certain time period from first aligning rollers 38 starting their rotation, it then signals that the sheet is jammed between first aligning rollers 38 and first discharge rollers 54.

Figure 2:
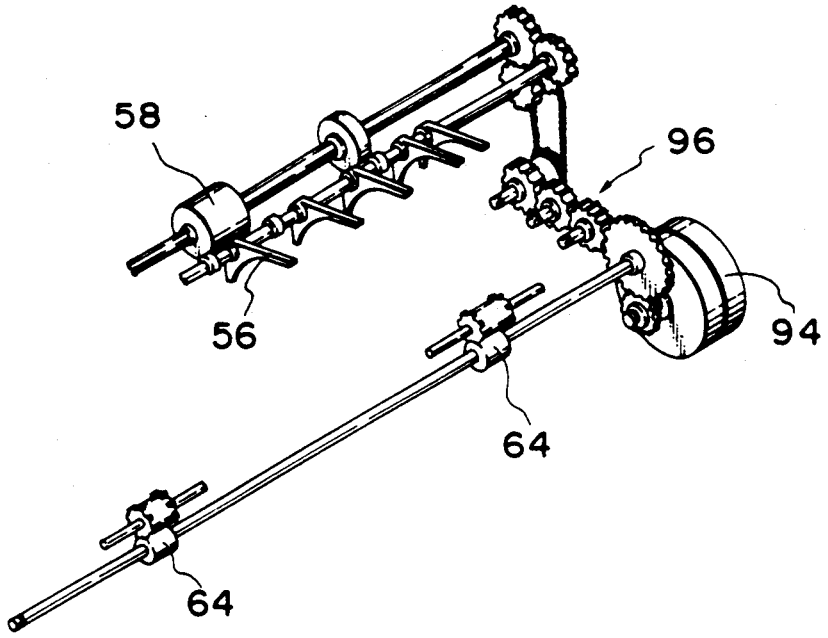
FIG. 2 is a perspective view showing the paper sheet-introducing system of a resupply unit housed in the copying machine shown in FIG. 1.

As is shown in FIG. 2, the drive force of first motor 94 is transmitted to second discharge rollers 58, first gate 56, and stack rollers 64 through first drive force transmission mechanism 96.

Figure 3:
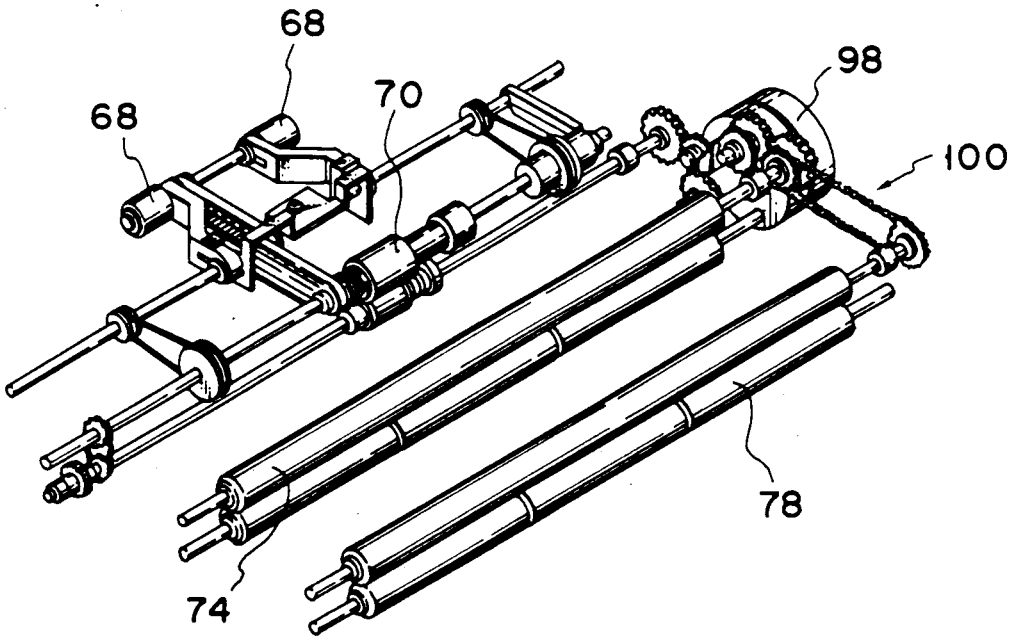
FIG. 3 is a perspective view showing the paper sheet-conveying system of the same resupply unit.

As is shown in FIG. 3, the drive force of second motor 98 is transmitted to pickup rollers 68, separating rollers 70, second aligning rollers 74, and switchback rollers 78 through second drive force transmission mechanism 100, with rollers 74 and 78 being rotated in the same direction by means of transmission mechanism 100.

Figure 4:
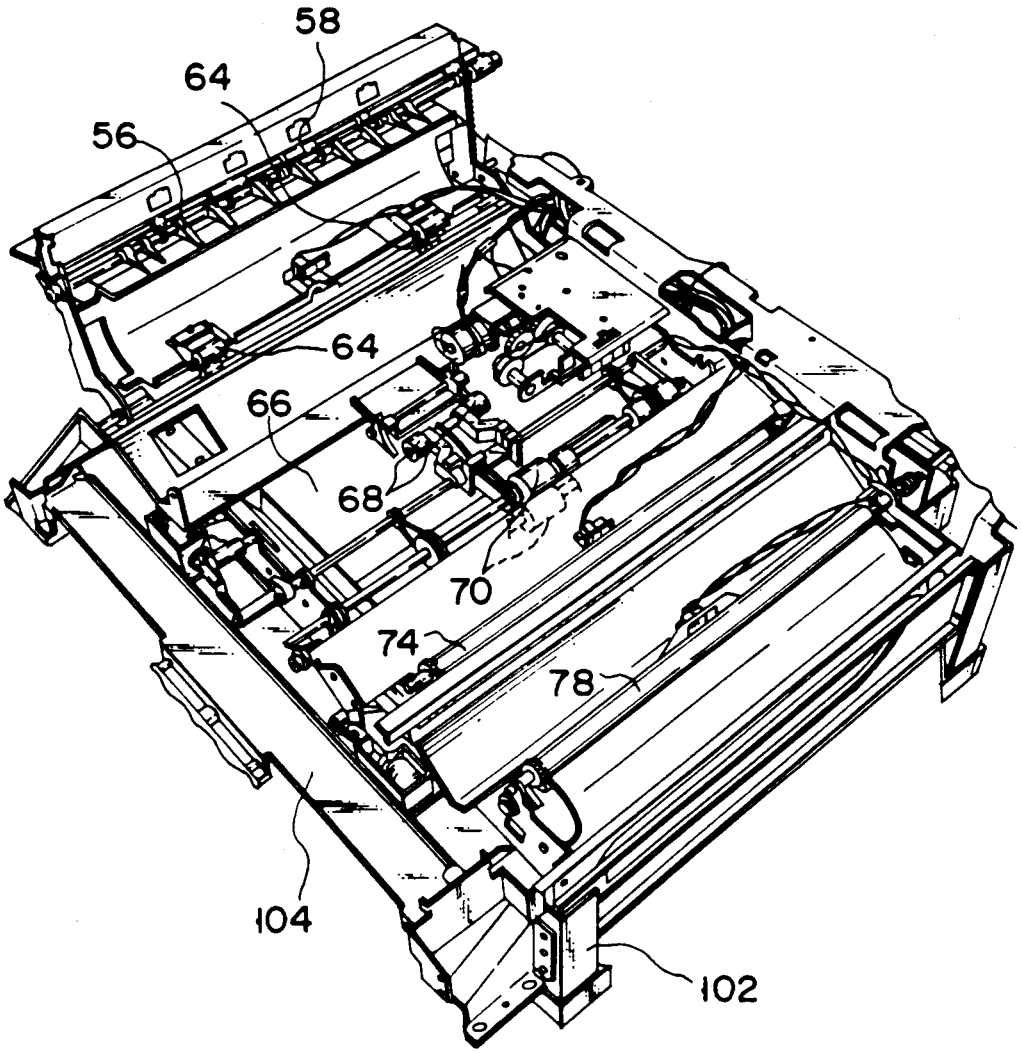
FIG. 4 is a perspective view showing the resupply unit.
Figure 5:
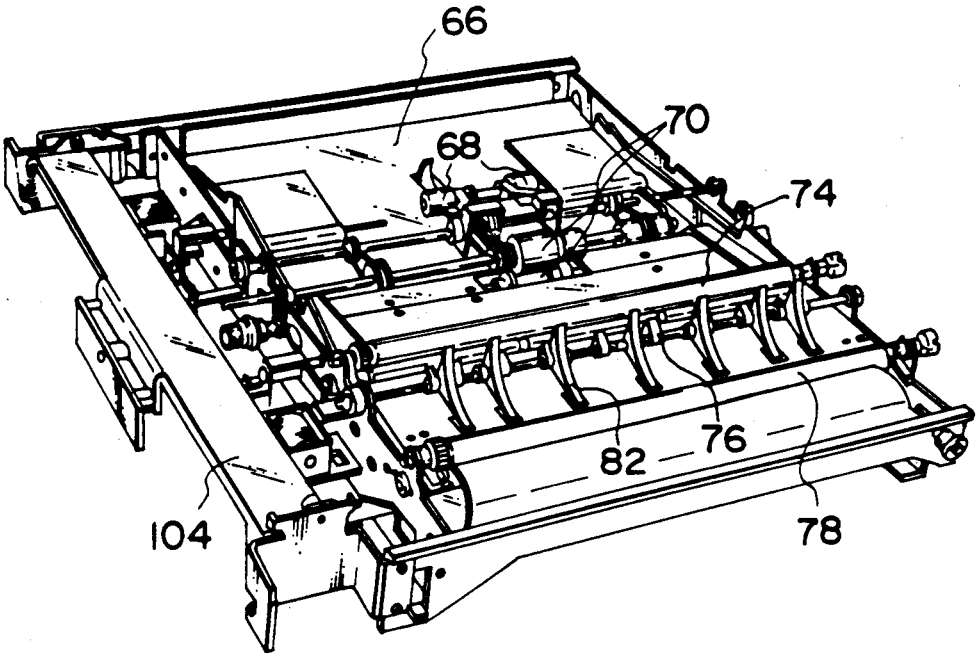
FIG. 5 is a perspective view showing a pull-out unit housed in the resupply unit shown in FIG. 4.
Figure 6:
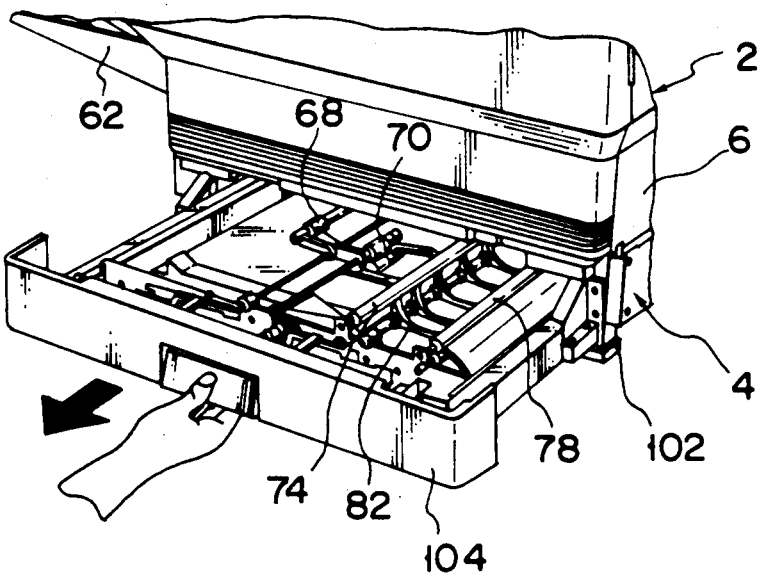
FIG. 6 is a perspective view showing the pull-out unit when removed from the resupply unit shown in FIG. 4.

Resupply unit 4 is divided into fixed unit 102 and pull-out unit 104, as is shown in FIG. 4. Of the components making up resupply unit 4, pull-out unit 104 includes stacker 66, pickup rollers 68, separating rollers 70, aligning rollers 74, second gate 76, third gate 82, and switchback rollers 78, as is shown in FIG. 5, the other components of resupply unit 4 being arranged on fixed unit 102. Pull-out unit 104 is supported by fixed unit 102 such, that it can be pulled out to the front side of resupply unit 4, as is shown in FIG. 6.

Figure 7:
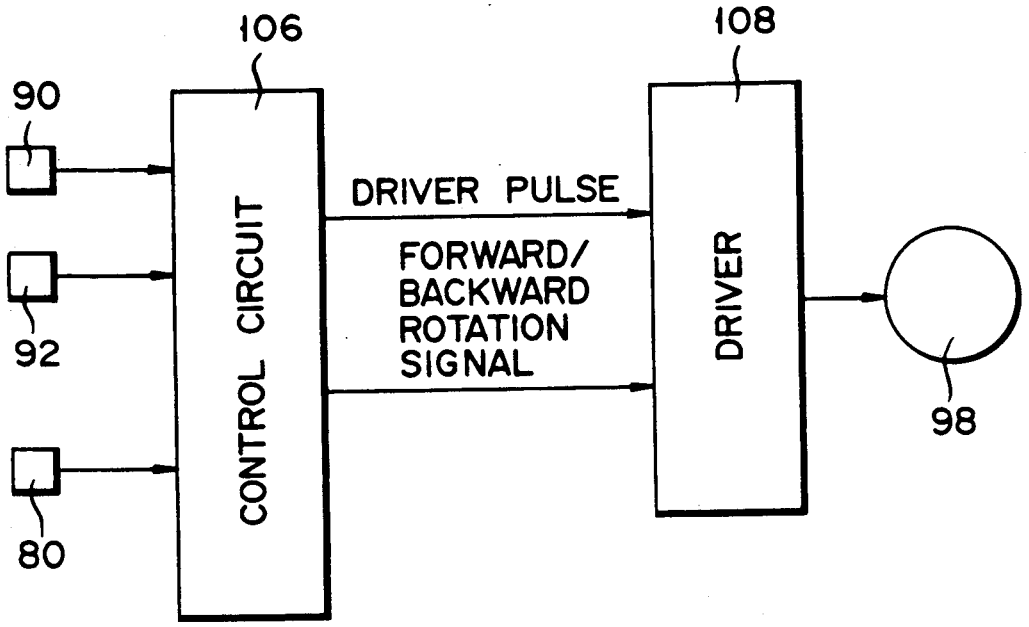
FIG. 7 is a diagram showing an electric circuit for dealing with the jamming of a paper sheet in the copying in FIG. 1.
Figure 8A:
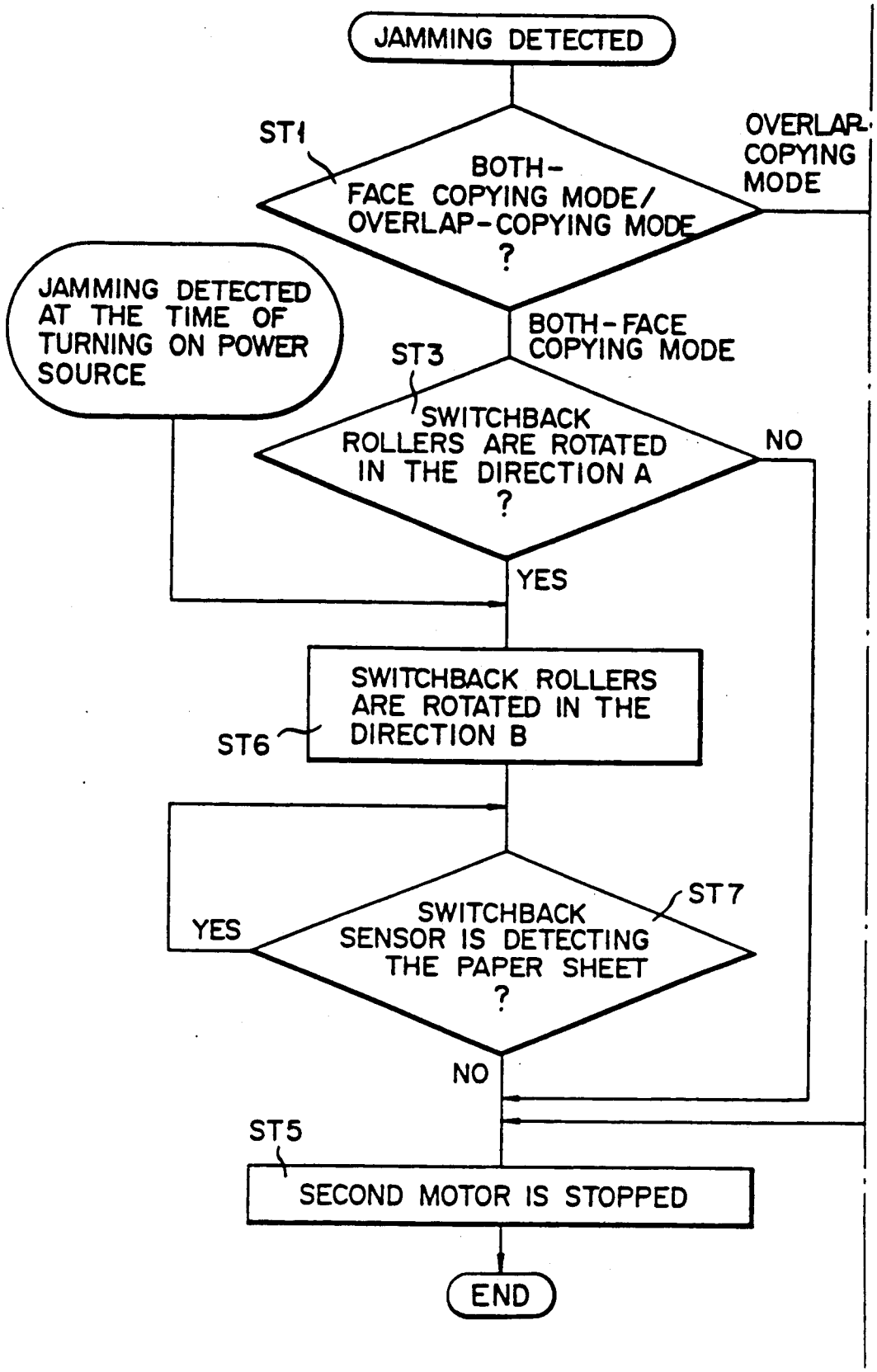
FIGS. 8A and 8B are a flow chart for explaining the process for dealing with the jamming of a paper sheet.
Figure 8B:
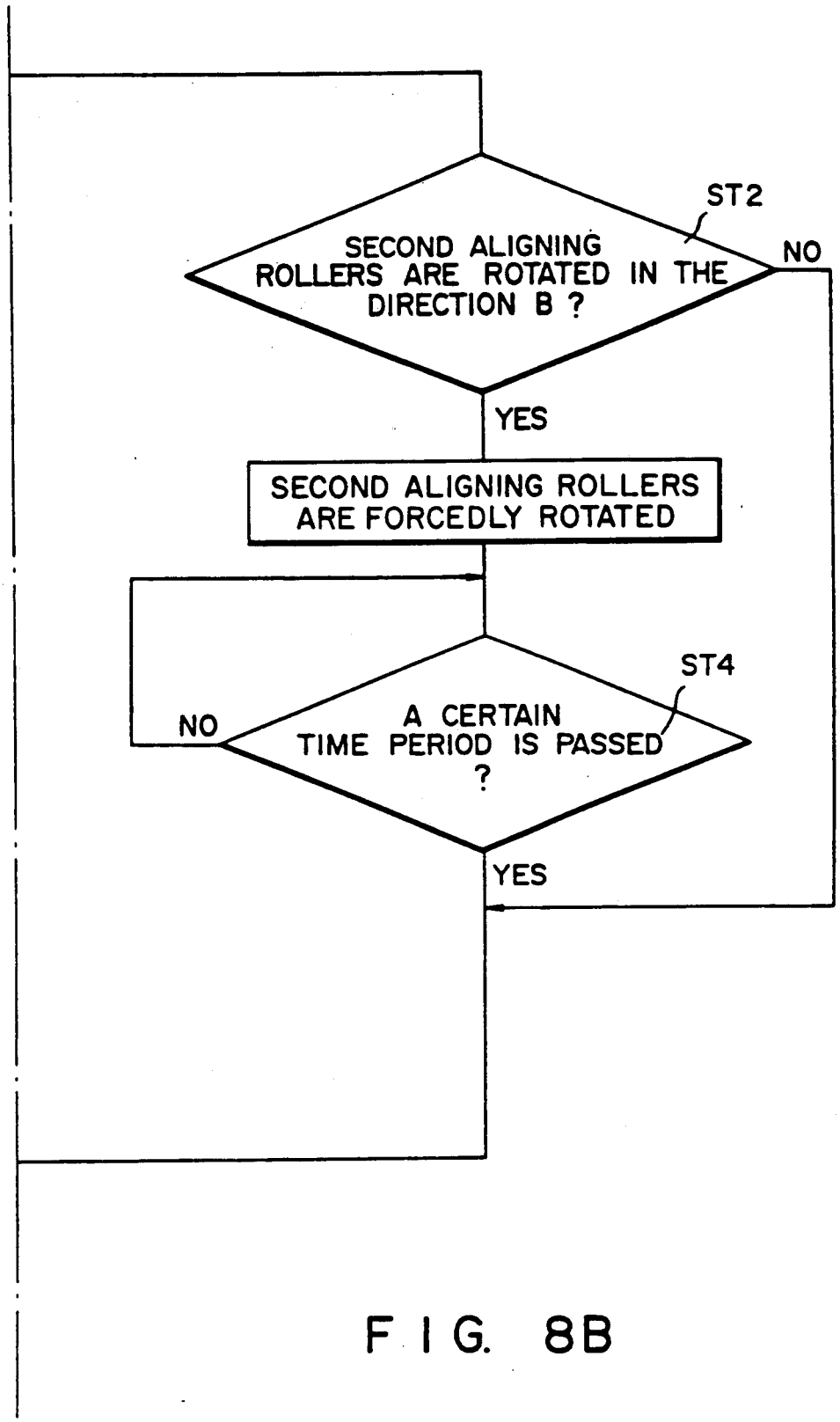

Signals detected by first and second jam sensors 90 and 92 and switchback sensor 80 are supplied to control circuit 106, as is shown in FIG. 7, and in response to these signals, control circuit 106 supplies motor drive pulses and forward/backward rotation signals to driver 108 which, in response thereto, drives second motor 98.

When the copy button on the operation panel (not shown) is pushed, the surface of photosensitive drum 10 is uniformly electrified by electrifying charger 12, in the case of the normal image forming operation. Thereafter, light reflected from the original on the originals table is introduced and imaged on the surface photosensitive drum 10 by the exposing device, whereby a static latent image is formed. This static latent image is developed by developing device 14, and a toner image is thus formed. In the meantime, a sheet of paper P is supplied from paper sheet supply cassette 26 or 28, is aligned by first aligning rollers 38, and then fed between photosensitive drum 10 and transfer charger 16. The toner image on photosensitive drum 10 is transferred to paper sheet P by transfer charger 16, and is fixed on the sheet by fixing rollers 50. Thereafter, the sheet is discharged, on discharge tray 62, through first discharge rollers 54, first gate 56, and second discharge rollers 58.

When the copy button on the operation panel is pushed in the case of the apparatus being in overlap copying mode, an image is formed on one face of the paper sheet, in a manner similar to that described above, and the paper sheet, after being fed through first discharge rollers 54, is then introduced to stack rollers 64 by first gate 56, through turn guide 60, and is stacked in stacker 66, by stack rollers 64, with its image-formed side facing downward. A necessary number of paper sheets are continuously stacked in stacker 66, and when a subsequent original has been placed on the originals table, and the copy button is pushed after this stacking operation has been completed, pickup rollers 68 are lowered onto the stacked paper sheets, and the top paper sheet P is thus fed to separating rollers 70. In the event of two or more paper sheets being fed inadvertently, the lower one of separating rollers 70 is rotated backward to thereby return the lower paper sheet(s) P to stacker 66, with only the top paper sheet P being conveyed. When pickup rollers 68 are then raised and the front end of the paper sheet P reaches second aligning rollers 74, the paper sheet P is aligned due to second aligning rollers 74 being stationery. Thereafter, when second aligning rollers 74 are rotated, following this aligning process, the paper sheet P is fed to first aligning rollers 38 in copying unit 2, through second gate 76, and after an overlapping image has been formed on that side of the sheet on which the preceding image was formed, the sheet is discharged, on discharge tray 62, through first discharge rollers, first gate 56, and second discharge rollers 58. This operation is repeated until all of the paper sheets P stacked in stacker 66 have been subjected to overlap copying and discharged.

The same operation as that which takes place in the overlap copying mode is also performed in the case of the double-sided copying mode, up until the alignment of the paper sheet P by second aligning rollers 74. Following this aligning operation, second gate 76 is made operative, and second aligning rollers 74 and switchback rollers 78 are rotated at the same time. Thus, the paper sheet P is fed to switchback rollers 78, and when the back end of the sheet passes over switchback sensor 80, second aligning rollers 74 and switchback rollers 78 are stopped at the same time and second gate 76 is returned to its original state. Switchback rollers 78 are then rotated backward and the paper sheet P is thus switched back and fed to first aligning rollers 38, through third gate 82, and after an image has been formed on that side of the paper sheet P opposite to that on which the preceding image was formed, the sheet is discharged, on discharge tray 62, through first discharge rollers 54, first gate 56, and second discharge rollers 58. The above operation is repeated until all of the paper sheets P stacked in stacker 66 are subjected to double-sided copying and discharged.

The steps which are taken in the event that first jam sensor 90 or second jam sensor 92 detects the jamming of a paper sheet P, in the overlap copying mode or the double-sided copying mode, will now be described, with reference to FIGS. 8A to 10.

Figure 9:
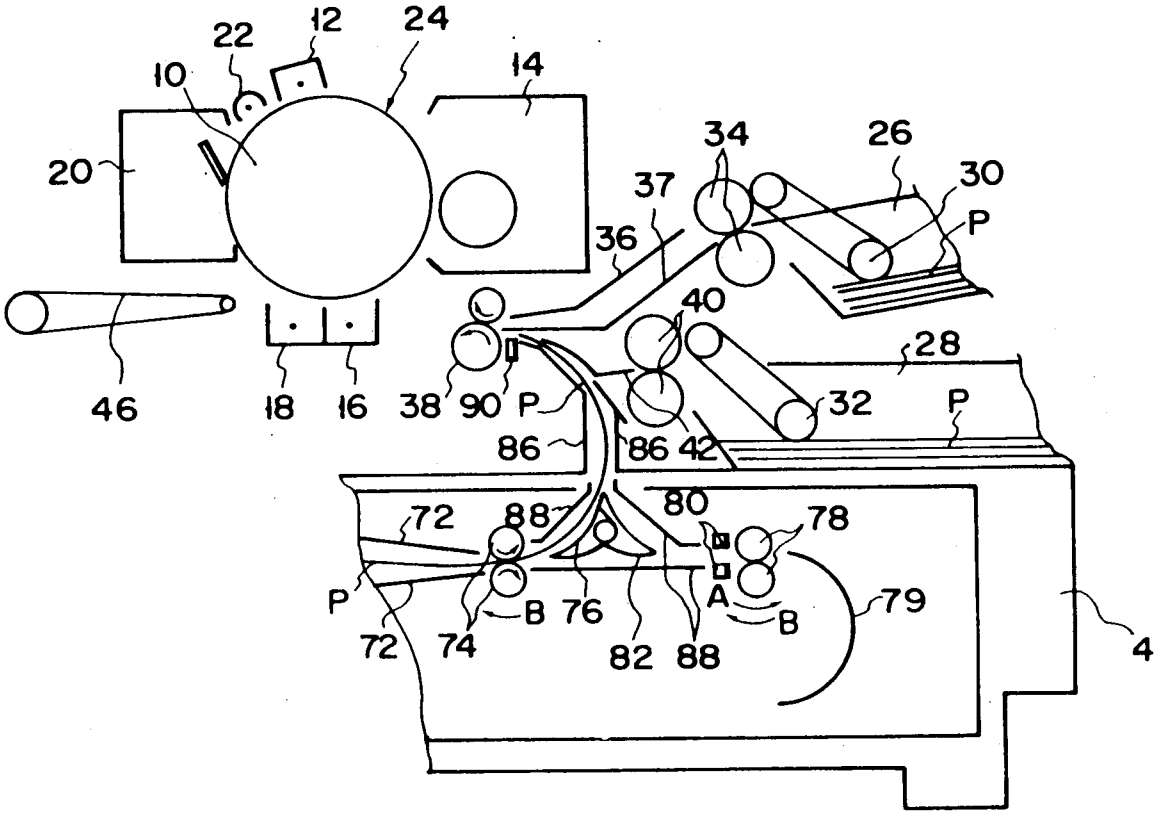
FIG. 9 is intended to explain the process of removing a paper sheet which has become jammed when the copying machine is in the overlap copying mode.

In step ST1, it is confirmed whether the copying operation currently being performed is taking place in the overlap copying mode or the double-sided copying mode. If the operation is taking place in the overlap copying mode, the process advances to step ST2, while if it is taking place in the double-sided copying mode, the process advances to step ST3. In step ST2, it is confirmed whether or not second aligning rollers 74 are rotating in direction B, as shown in FIG. 9. If second aligning rollers 74 are rotating in direction B, this means that the paper sheet P has been conveyed thereby toward first aligning rollers 38, and that therefore the paper sheet P, must be jammed somewhere between second aligning rollers 74 of pull-out unit 104 in resupply unit 4 and first aligning rollers 38 in copying unit 2. In this case, when unit 104 is pulled out in order to remove the jammed paper sheet P, the paper sheet will be torn apart between pull-out unit 104 and copying unit 4. If, on other hand, second aligning rollers 74 are not rotating in direction B, this means that they are not feeding the paper sheet P, and that therefore the paper sheet is not jammed between second aligning roller 74 and first aligning roller 38. In this case, when pull-out unit 104 is pulled out, the paper sheet P will not be torn apart. Therefore, when it is confirmed that, in step ST2, second aligning rollers 74 are rotating in direction B, the process then advances to step ST4; when they are not rotating in direction B, the process advances to step ST5.

In step ST4, it is confirmed whether or not a predetermined time period necessary for the paper sheet P to pass through second aligning rollers 74 has passed since second aligning rollers 74 are forcedly rotated. When the certain time period passes, the paper sheet P has been passed through second aligning rollers 74. The paper sheet P is not torn apart when the pull-out unit 104 is pulled out under this state. When the predetermined time period has passed, the process then advances to step ST5.

In step ST5, second motor 98 is stopped.

Figure 10:
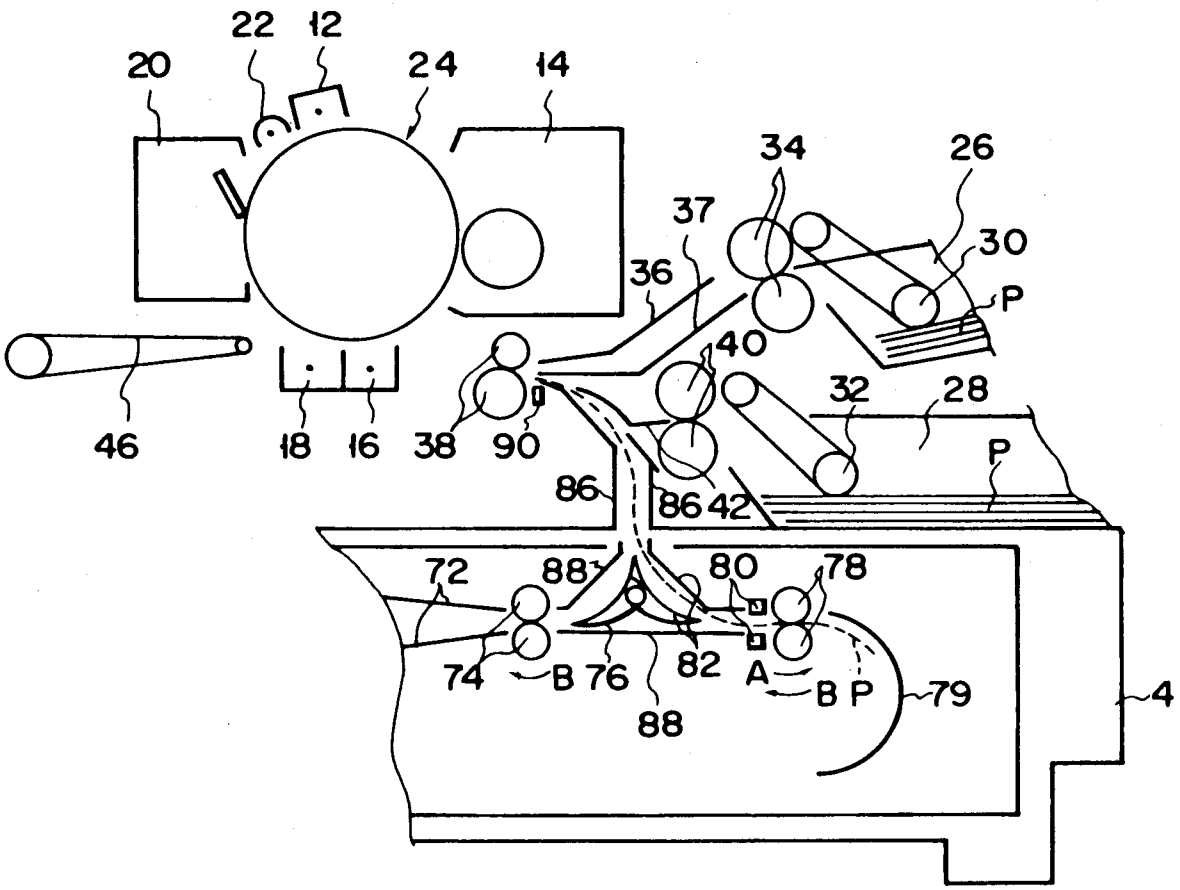
FIG. 10 is intended to explain the process of removing a paper sheet which has become jammed when the copying machine is in the double-sided copying mode.

In step ST3, it is confirmed whether or not switchback rollers 78 are rotating in direction A, as shown in FIG. 10. If switchback rollers 78 are rotating in direction A, this means that the paper sheet P has been conveyed thereby toward first aligning rollers 38, and that therefore the paper sheet P must be jammed somewhere between switchback rollers 78 of pull-out unit 104 in resupply unit 4 and first aligning rollers 38 in copying unit 2. In this case, when pull-out unit 104 is pulled out in order to remove the jammed paper sheet P, the paper sheet P will be torn apart between pull-out unit 104 and copying unit 2. If, on the other hand, switchback rollers 78 are not rotating in direction A, this means that they are not conveying the paper sheet P, and that therefore the paper sheet P is not jammed between switch-back rollers 78 and first aligning rollers 38. In this case, when pull-out unit 104 is pulled out, the paper sheet P will not be torn apart. Therefore, when, in step ST3, switchback rollers 78 are confirmed to be rotating in direction A, the process advances to step ST6; when they are not rotating in direction A, the process advances to step ST5.

In step ST6, switchback rollers 78 are forcedly rotated in direction B, and the process advances to step ST7.

In step ST7, it is confirmed whether or not the paper sheet P has been detected by switchback sensor 80, and if the sheet has been detected thereby, this means that the sheet is located somewhere between first aligning rollers 38 and switchback rollers 78. Accordingly, switchback rollers 78 are further rotated, in order to dislodge the jammed sheet, and when switchback sensor 80 no longer detects the presence of paper sheet P, the process advances to step ST5.

Second motor 98 is stopped at step ST5. The paper sheet P is not jammed between first and second aligning rollers 38 and 74 under this state and even when the pull-out unit 104 is pulled out as shown in FIG. 6, therefore, the paper sheet P is not broken. This enables the jammed paper sheet P to be removed without breaking it.

Just after the power source is turned on, first aligning rollers 38, photosensitive drum 10, fixing rollers 50, conveying belt 46, first discharge rollers 54 in copying unit 2 and second aligning rollers 74, switchback rollers 78, second discharge rollers 58 in resupply unit 4 are forcedly driven to forcedly discharge any of paper sheets. When the jamming of the paper sheet P is detected even after this operation of forcedly discharging any of paper sheets is finished, the process advances to step ST6.

According to the image forming apparatus having the above-described arrangement, a jammed paper sheet P can be removed therefrom without being torn apart, even when it is jammed between the first and second aligning rollers.

What is claimed is:

1. An image forming apparatus comprising:

a copying unit having image forming means for forming images on paper sheets, and transporting means for transporting paper sheets to the image forming means and transporting the paper sheets on which images have been formed from the image forming means to the outside of the copying unit;

a paper resupply unit having re-transporting means for transporting the paper sheets on which the images have been formed back to the image forming means so that the image forming means may form other images thereon, a transporting path defined between the transporting means and the re-transporting means through which the paper sheets are introduced from the re-transporting means to the transporting means, and first roller means for turning over the paper sheets on which the images have been formed and for feeding the turned-over paper sheets into the transporting means through the transporting path so as to enable images to be formed on both sides of the paper sheets by the image forming means;

detecting means for detecting whether or not one of the paper sheets is jammed in the apparatus;

drive means for driving the re-transporting means; and control means for detecting the rotating condition of the first roller means in response to the detection of the jamming of the paper sheets, and for operating the drive means in accordance with the detected rotating condition so that the jammed paper sheet is discharged from the transporting path.

2. An image forming apparatus according to claim 1, wherein said drive means includes means for rotating the first roller means in a forward direction so as to turn over the paper sheets and rotating the first roller means in a reverse direction so as to feed the turned-over paper sheets into the transporting means through the transporting path; and said control means including means for operating the drive means so that the first roller means is forcedly rotated in the forward direction to discharge the jammed paper sheet from the transporting path if the control means detects that the first roller rotates in the reverse direction.

3. An image forming apparatus according to claim 1, wherein said control means includes means for operating the drive means so as to stop the rotation of the first roller means if the control means detects that the first roller means is not rotated in the reverse direction.

4. An image forming apparatus according to claim 1, wherein said re-transporting means includes second roller means for feeding the paper sheets, on which the images have been formed, into the transporting means through the transporting path so as to enable images to overlap on the paper sheets by the image forming means, and said control means includes means for detecting the rotating condition of the second roller means in response to the detection of the jamming of the paper sheets and for operating the drive means in accordance with the detected rotating condition.

5. An image forming apparatus according to claim 4, wherein said drive means includes means for rotating the second roller means in a forward direction so as to feed the paper sheets into the transporting means through the transporting path; and said control means including means for operating the drive means so that the second roller means is forcedly rotated in the forward direction to discharge the jammed paper sheet from the transporting path independent of the rotation of the first roller.

6. An image forming apparatus according to claim 4, wherein said control means includes means for operating the drive means so as to stop the rotation of the second roller means independent of the rotation of the first roller.

7. An image forming apparatus according to claim 4, wherein said re-transporting means includes: first gate means arranged between the first and second roller means and movable between a first position for guiding the paper sheets fed from the second roller means to the transporting path and a second position for guiding the paper sheet fed from the second roller means to the first roller means; and second gate means arranged between the first gate means and the first roller means and movable between a first position for guiding the paper sheet passed through the first gate means to the first roller means and a second position for guiding the paper sheet fed from the first roller means to the transporting path.

8. An image forming apparatus according to claim 7, wherein said re-transporting means includes a sensor for detecting the back end of the paper sheet passed through the first gate means, and said control means includes means for operating the drive means so as to change the rotating direction of the first roller means from the forward direction to the reverse direction when the back end of the paper sheet is detected by the sensor.

9. An image forming apparatus comprising:

a copying unit having image forming means for forming images on paper sheets, and transporting means for transporting paper sheets to the image forming means and transporting the paper sheets on which images have been formed from the image forming means to outside of the copying unit; and a paper resupply unit having re-transporting means for transporting the paper sheets, on which the images have been formed back to the image forming means so that the image forming means may form other images on the paper sheets, said resupply unit including a pull-out unit supporting said re-transporting means thereon and arranged in the copying unit to be movable between an operating position wherein a transporting path is defined between the transporting means and the re-transporting means, through which the paper sheets are introduced from the re-transporting means to the transporting means, and a pulled-out position wherein the re-transporting means is pulled out from the copying unit and the transporting path is interrupted, said re-transporting means including first roller means for turning over the paper sheets on which the images have been formed and for feeding the turned-over paper sheets into the transporting means through the transporting path so as to enable images to be formed on both sides of the paper sheet by the image forming means, and second roller means for feeding the paper sheets, on which the images have been formed, into the transporting means through the transporting path so as to enable images to be overlapped on the paper sheet by the image forming means;

detecting means for detecting whether or not the paper sheet is jammed in the apparatus;

drive means for driving the re-transporting means; and control means for detecting the rotating condition of the first and second roller means in response to the detection of the jamming of the paper sheets, and operating the drive means in accordance with the detected rotating condition so that the jammed paper sheet is discharged from the transporting path.

* * * * *